US006043598A

United States Patent [19]

Park et al.

[11] Patent Number: 6,043,598

[45] Date of Patent: Mar. 28, 2000

[54] HIGH RESOLUTION COLOR PICTURE TUBE HAVING A SMALL DIAMETER NECK

[75] Inventors: Won-Sueg Park; In-Kyu Park, both of Kyungki-do, Rep. of Korea

[73] Assignee: Samsung Display Devices Co., Ltd., Kyungki-do, Rep. of Korea

[21] Appl. No.: 08/995,608

[22] Filed: Dec. 22, 1997

[30] Foreign Application Priority Data

May 29, 1997 [KR] Rep. of Korea ..... 97-21631

[51] Int. Cl.[7] ..... H01J 29/76

[52] U.S. Cl. ..... 313/440; 313/426

[58] Field of Search ..... 313/440, 412, 313/413, 414, 417, 425, 428, 432, 439, 449, 458, 460, 426

[56] References Cited

U.S. PATENT DOCUMENTS 5,710,480 1/1998 Uchida et al. ..... 313/414

*Primary Examiner*—Nimeshkumar D. Patel
*Assistant Examiner*—Joseph Williams
*Attorney, Agent, or Firm*—Christie, Parker & Hale, LLP

[57] ABSTRACT

A color picture tube having an in-line electron gun includes a front panel, a funnel sealed to the rear of the panel, a neck connected to the rear of the funnel and provided with an internal in line electron gun and a plurality of electrodes for focusing and accelerating electron beams emitted from the electron gun, and a deflection yoke mounted around the funnel to scan the electron beams across the screen of the panel. An outer diameter NO of the neck is defined by 22.5 mm<NO≦24.0 mm and the relationship between the distance P between centers of neighboring beam-guide holes of the electrodes and the outer diameter NO of the neck is defined by 4.1<NO/P<5.4.

2 Claims, 2 Drawing Sheets

HIGH RESOLUTION COLOR PICTURE TUBE HAVING A SMALL DIAMETER NECK

BACKGROUND OF THE INVENTION

1. Field of the Invention

The present invention relates to a color picture tube having an in-line electron gun, and more particularly, to a color picture tube having an in-line electron gun for high-resolution display with a neck having a minimized diameter.

2. Description of the Related Art

Generally, the resolution of the color picture display screen depends largely on the spot size of the electron beam. Therefore, the spot size of the electron beam should be minimized to realize a high-resolution display.

The color picture tube is usually provided with an in-line electron gun in which three cathodes are arranged in a horizontal line to excite three different phosphors that produce the three primary colors, red (R), green (G), and blue (B). The in-line electron gun emits a plurality of electron beams to produce the colored image on the phosphor screen.

The in-line electron gun is mounted within the neck of the color picture tube and includes a series of electrodes which focuses and accelerates the electron beams. The electrodes each are provided with beam-guide holes for passing the electron beams R, G and B. A deflection yoke is mounted around a funnel of the color picture tube to scan the electron beams emitted from the electron gun across the screen of the panel.

The electrodes each have one or three beam-guide holes for passing the three electron beams.

The beam spot size Dt of the in-line electron gun is given by $D_t=\sqrt{((D_x+D_{sa})^2+D_{sc}^2)}$ where $D_x$ is the diameter of the beam spot magnified by the main lens; $D_{sa}$ is the diameter of the beam spot formed by the spherical aberration of the main lens, and is defined by $D_{sa}=0.5\times(MC_{so}\,\alpha_o^3)$, where M is the magnification ratio of the main lens, $\alpha_o$ is the incidence angle of the main lens, and $C_{so}$ is the coefficient of the spherical aberration; and $D_{sc}$ is the diameter of the beam spot formed by repulsion of the charges of electrons.

Accordingly, the spot size of the electron beam is reduced as the spherical aberration of the main lens is diminished. And a method of enlarging the beam-guide holes of the electrodes in the main lens has been employed in the past to diminish the spherical aberration of the main lens.

However, in that method, the size of the electrodes, as well as the diameter of the neck, is also enlarged requiring a large amount of current for the deflection coils of the deflection yoke to scan the electron beams across the screen. Furthermore, the power consumption, as well as the amount of magnetic field leakage, increases during the deflecting operation of the deflection yoke. Thus, a separate electron beam shielding device is also needed resulting in increased production costs.

SUMMARY OF THE INVENTION

Accordingly, an embodiment of the present invention is directed to a color picture tube having an in-line electron gun which substantially obviates one or more of the problems due to limitations and disadvantages of the related art.

An object of an embodiment of the present invention is to provide a color picture tube having an in-line electron gun for high-resolution display with a neck having a minimized diameter, thereby reducing power consumption as well as the amount of the magnetic field leakage of the deflection yoke.

Additional features and advantages of the invention will be set forth in the description which follows, and in part will be apparent from the description, or may be learned by practice of the invention. The objects and other advantages of the invention will be realized and attained by the structure particularly pointed out in the written description and claims hereof as well as the appended drawings.

To accomplish these and other advantages, the color picture tube having an in-line electron gun includes a front panel, a funnel sealed to the rear of the panel, a neck connected to the rear of the funnel and provided with an internal in-line electron gun, and a deflection yoke mounted around the funnel to scan the electron beams emitted from the electron gun across the screen of the panel. The outer diameter NO of the neck is defined by $22.5\text{ mm}<NO\leqq 24.0$ mm, and the relationship between the distance P between the centers of the neighboring beam-guide holes of the electron gun and the outer diameter NO of the neck satisfies $4.1<NO/P<5.4$.

The above formula between the outer diameter of the neck and the eccentric distance of the neighboring beam-guide holes reduces power consumption required for deflecting the electron beams without increasing the spot size.

It is to be understood that both the foregoing general description and the following detailed description are emplary and explanatory and are not intended to be limiting of the invention.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention. In the drawings.

In the following detailed description, only the preferred embodiment of the invention has been shown and described, simply by way of illustration of the best mode contemplated by the inventor(s) of carrying out the invention. As will be realized, the invention is capable of modification in various other respects, all without departing from the invention. Accordingly, the drawings and description are to be regarded as illustrative in nature, and not as restrictive.

DETAILED DESCRIPTION OF THE INVENTION

Reference will now be made in detail to the preferred embodiment of the present invention, examples of which are illustrated in the accompanying drawings.

Figure 1:
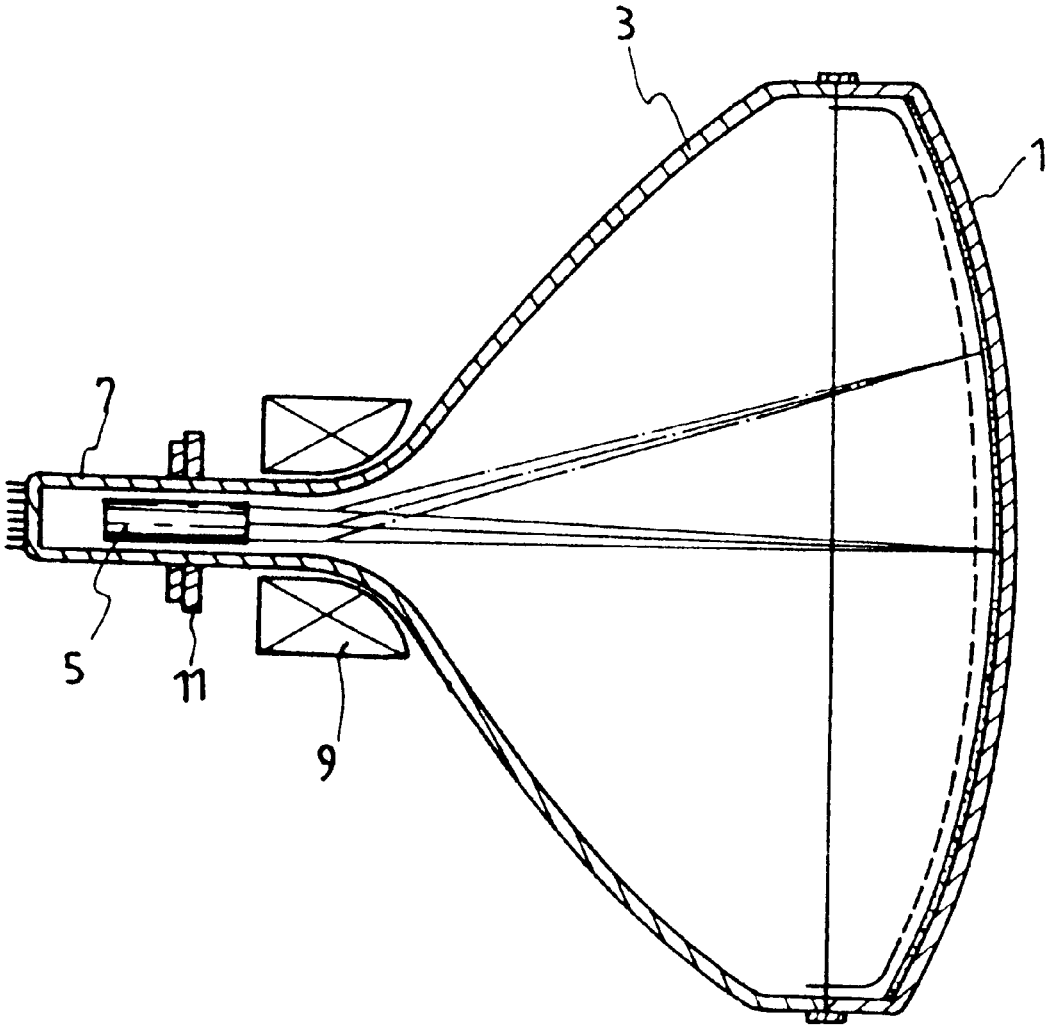
FIG. 1 is a sectional schematic view showing a color picture tube having an in-line electron gun in accordance with a preferred embodiment of the preset invention.
Figure 2:
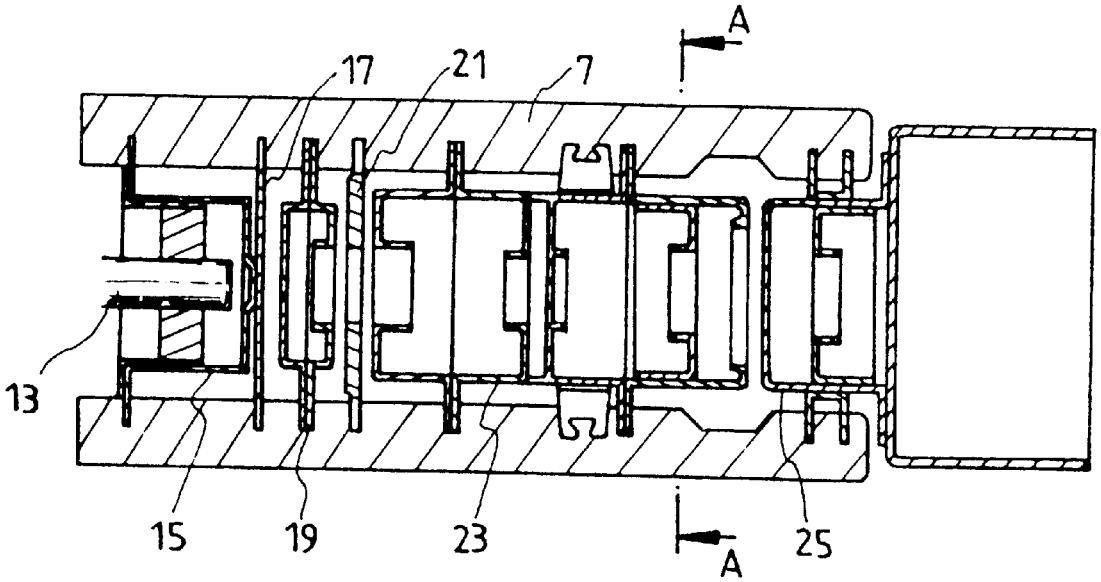
FIG. 2 is a fragmentary sectional view of a color picture tube according to a preferred embodiment of the present invention.
Figure 3:
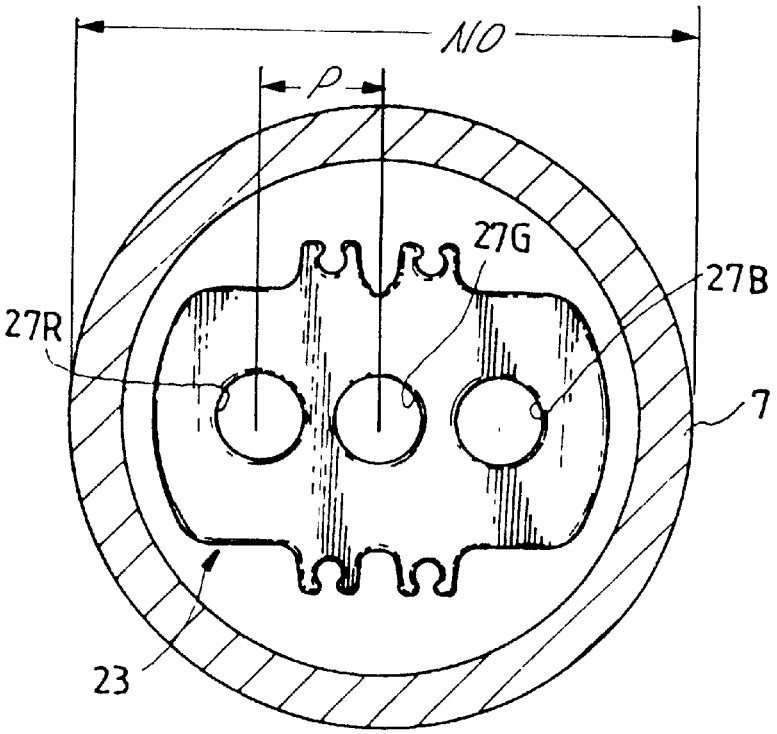
FIG. 3 is a sectional view taken along line A—A of FIG. 2.

Referring to FIGS. 1 to 3, the color picture tube includes a front panel 1, a funnel 3 sealed to the rear of the panel 1, a neck 7 connected to the rear of the funnel 3 and provided with an internal in-line electron gun 5, and a deflection yoke 9 mounted around the funnel 3 to scan electron beams emitted from the electron gun 5 across the screen of the panel 1.

A conductive material, such as graphite or oxidized steel, is coated on the interior and exterior of the funnel 3. The conductive material acts as a condenser.

A plurality of convergence purification magnets 11 surround the neck 7 to converge the electron beams emitted from the electron gun 5 on a point on the panel 1. The convergence purification magnets 11 include pairs of two-pole, four-pole and six-pole magnets or, alternatively, pairs of four-pole and six-pole magnets.

The in-line electron gun 5 includes a triode unit comprising cathodes 13, and first and second electrodes 15 and 17. The in-line electron gun 5 further includes a focusing unit comprising third, fourth and fifth electrodes 19, 21 and 23. The focusing unit is connected to the triode unit while being maintained at a different electric potential than the triode unit for focusing the electron beams. The in-line electron gun 5 also includes a sixth electrode 25 having a voltage equal to a voltage applied to the interior of the panel 1 and funnel 3 to accelerate the electron beams.

The cathodes 13 are composed of three units for emitting thermal electron beams, R, G and B. The aforementioned electrodes are arranged in parallel to each other so that the electron beams produced from the cathodes 13 are passed therethrough.

The neck 7 has a predetermined inner and outer diameter. As shown in FIG. 3, the fifth electrode, as well as the other electrodes, has beam-guide holes 27R, 27G and 27B for passing the electron beams R, G and B. The inner surface of the neck 7 is spaced apart from the outer surface of the electrode 23 at a predetermined distance to prevent them from electrically contacting with each other. The centers of the neighboring beam-guide holes are also spaced apart from each other by a predetermined distance. Likewise, the side beam-guide holes 27R and 27B are spaced apart from the outer surface of the electrode 23 by a predetermined distance. These parameters are controlled because the spot size of the electron beam varies in accordance with the distance between the inner surface of the neck 7 and the side beam-guide holes 27R and 27B as well as the distance between the neighboring beam-guide holes.

In an embodiment of the inventive color picture tube, the outer diameter NO of the neck 7 is defined by 22.5 mm<NO ≦24.0 mm and the relationship between the distance P between the centers of the neighboring beam-guide holes and the outer diameter NO of the neck 7 is defined by 4.1<NO/P<5.4.

The cathodes 13, each coated with a carbonate, emit three electron beams R, G and B when heated. The three electron beams emitted from the cathodes 13 pass through the first and second electrodes 15 and 17. Thereafter, the electron beams are focused while passing through the beam-guide holes 27R, 27G and 27B of the third, fourth and fifth electrodes 19, 21 and 23 of the focusing unit. Then, the beams are accelerated by the main lens formed by the sixth electrode 25 to excite the phosphors on the screen, and produce an optimum beam spot on a central point of the panel 1.

The convergence purification magnets 11 are mounted on the neck 7 between the deflection yoke 9 and the main lens to converge the two side electron beams R and B and the central electron beam G on a point on the panel 1.

The deflection yoke 9, mounted around the funnel 3, forms vertical and horizontal magnetic fields so that the electron beams emitted from the electron gun 5 can be deflected over the entire surface of the screen of the panel 1.

As noted from the following formula, the smaller the distance between the electron beam and the deflection yoke is, the less current required for deflecting the electron beam. The required current is defined by the following formulas:

$$K=LI^2/2 \quad (1)$$

where L is the inductance of the deflection yoke (H), I is the deflection yoke current required for deflecting the electron beam (A), and K is the power consumption of the deflection yoke (J); and $$I=KD/R \quad (2)$$

where D is the length of the uniform magnetic field, and R is the deflection radius of electron beam.

As shown by the above equations, the power consumption of the deflection yoke 9 is reduced in proportion to the square of the current. Likewise, the amount of magnetic field leakage is reduced by deflecting the electron beam with minimum current. Thus, if minimum current can be achieved, a separate electron beam shielding device will not be needed, thereby reducing production costs.

In order to reduce the distance between the electron beam and the purification magnets, the outer diameter of the neck 7 needs to be reduced. However, the reduction of the diameter of the neck 7 is limited by the resulting expansion of the spherical aberration of the electron gun and the corresponding increase in beam spot size on the screen.

Accordingly, as a preferred embodiment of the inventive method, satisfaction of the aforementioned formula between the outer diameter of the neck 7 and the centers of the beam-guide holes 27R, 27G and 27B results in decreased power consumption of the deflection yoke without affecting the electron beam spot size on the screen.

Furthermore, as the diameter of the neck 7 decreases, the magnetic property of the convergence purification magnets 11 deteriorates due to the heat generated from the neighboring elements, such as the cathode heater, when they are positioned on the neck 7 as in the conventional CRTs. However, in an embodiment of this invention, the convergence purification magnets are mounted on the neck 7 between the deflection yoke 9 and the main lens so that the magnetic property of the convergence purification magnets 11 can be maintained.

As described above, a high-resolution in-line color picture tube according to the present invention is provided with a neck having a reduced diameter. Consequently, the power consumption, as well as the amount of magnetic field leakage of the deflection yoke, is diminished, and the total production costs are greatly reduced.

It will be apparent to those skilled in the art that various modifications and variations can be made in the color picture tube having an in-line electron gun of the present invention without departing from the spirit or scope of the invention. Thus, it is intended that the present invention cover modifications and variations of this invention provided they come within the scope of the appended claims and their equivalents.

What is claimed is:

1. A color picture tube having an in-line electron gun, the color picture tube comprising:

a panel having a screen;

a funnel sealed to a rear of the panel;

a neck connected to a rear of the funnel, said neck having an internal in-line electron gun and a plurality of electrodes, each of the electrodes having a plurality of beam-guide holes for focusing and accelerating electron beans emitted from the electron gun; and a deflection yoke mounted around the funnel to scan the electron beams across the screen, wherein an outer diameter NO of the neck is about 22.5 mm<NO<24.0 mm, and the relationship between a distance P between centers of neighboring beam-guide holes of the electrodes and the outer diameter NO of the neck is about 4.1<NO/P<5.4.

2. The color picture tube of claim 1 wherein said electrodes includes a main lens, and further comprising a plurality of convergence purification magnets mounted on the neck between the deflection yoke and the main lens.

* * * * *